United States Patent [19]

Causton et al.

[11] 4,250,025

[45] Feb. 10, 1981

[54] SIEVING DEVICE FOR MAGNETICALLY SUSCEPTIBLE PARTICLES

[75] Inventors: Robert J. Causton, St. Neots; Joseph Richardson, Cleckheaton, both of England

[73] Assignee: Davy-Loewy Limited, Sheffield, England

[21] Appl. No.: 32,965

[22] Filed: Apr. 24, 1979

[30] Foreign Application Priority Data

Apr. 28, 1978 [GB] United Kingdom ..... 16962/78

[51] Int. Cl.[3] ..... B03C 1/30

[52] U.S. Cl. ..... 209/38; 209/227; 209/233; 209/368

[58] Field of Search ..... 209/38, 212, 331, 341, 209/346, 368, 227, 214, 223 R, 215, 217; 210/233, 222, 223

[56] References Cited

U.S. PATENT DOCUMENTS

| | | | |
|---|---|---|---|
| 714,256 | 11/1902 | Sutton | 209/130 X |
| 935,216 | 9/1909 | Meiklejohn | 209/368 X |
| 1,130,950 | 12/1914 | Lindsay | 209/368 X |
| 1,463,713 | 7/1923 | Morney | 209/227 |
| 1,519,237 | 12/1924 | Brown | 209/346 X |
| 1,772,590 | 8/1930 | Traylor | 209/346 X |
| 1,848,473 | 3/1932 | Gorbuit | 209/346 X |
| 2,067,584 | 1/1937 | Stearns | 209/38 X |
| 2,297,084 | 9/1942 | Swallow | 209/368 X |
| 3,241,671 | 3/1966 | Brauchla | 209/331 X |
| 3,950,661 | 4/1976 | Langmuir | 209/227 X |
| 4,055,489 | 10/1977 | Soley | 209/231 X |

FOREIGN PATENT DOCUMENTS

| | | | |
|---|---|---|---|
| 1928534 | 12/1970 | Fed. Rep. of Germany | 209/341 |
| 1121451 | 7/1968 | United Kingdom | 209/212 |
| 544466 | 2/1977 | U.S.S.R. | 209/38 |

*Primary Examiner*—Robert Halper
*Attorney, Agent, or Firm*—Lee & Smith

[57] ABSTRACT

A sieving device comprises a sieve with an electrical linear device mounted in spaced apart relation from the mesh of the sieve. Particles supplied to the side of the mesh away from the thrust device are caused by the thrust device to move across the mesh and those which are smaller than the mesh pass through the mesh and towards the thrust device. Conveniently a plate is disposed between the mesh and the plate. Particles passing through the mesh then come into contact with the plate and move along it under the influence of the thrust device.

10 Claims, 2 Drawing Figures

SIEVING DEVICE FOR MAGNETICALLY SUSCEPTIBLE PARTICLES

This invention relates to a device for sieving particles of magnetically susceptible materials.

In the manufacture of metal powders and the manufacture of articles from metal powder it is necessary to sieve the powder in order to classify it into particle size. It is known to place the powder in a sieve and to vibrate the sieve by electro-magnetic means to cause the particles which are smaller than the mesh of the sieve to pass therethrough and for the larger particles to remain in the sieve.

It is an object of the present invention to provide an improved sieve which is capable of sieving magnetically susceptible materials.

According to the present invention, a sieving device comprises an electric linear thrust device mounted in spaced apart relation from the mesh of a sieve.

In use, a mixture of particles of different sizes of a magnetically susceptible material such as a ferrous powder, low alloy steel powder—EN31, high alloy ferrous powders,—high speed tool steel and other magnetic alloys, is placed in the sieve and the linear thrust device is energised. The particles are caused to move across the surface of the sieve and those particles which are smaller than the size of the mesh pass through the sieve towards the linear thrust device. Those particles which do not pass through the sieve collect at one end of the sieve, while the smaller particles which pass through the sieve collect at one end of the thrust device. By reversing the ends of the sieve, multiple sieving can be obtained.

The particles move across the sieve and also have a component of movement in the direction normal to the sieve so that blinding or blocking of the sieve mesh is avoided.

Preferably there is a plate located between the sieve and the thrust device and the particles which pass through the sieve move along to one end of the plate.

Figure 1:
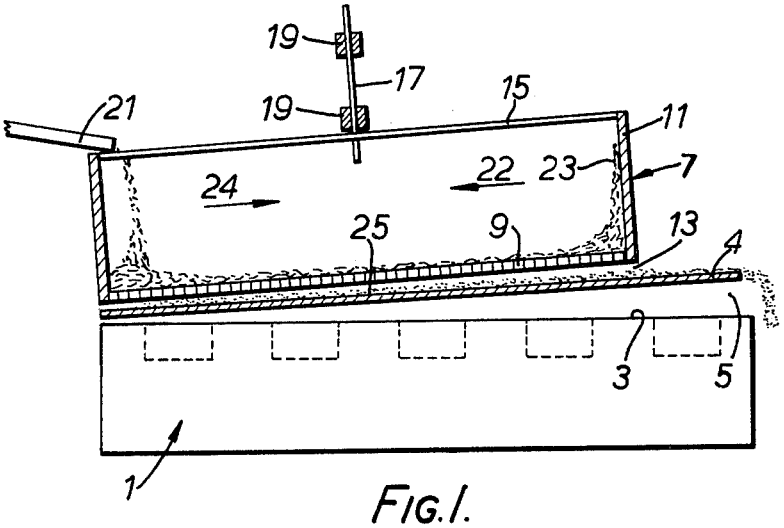
Figure 2:
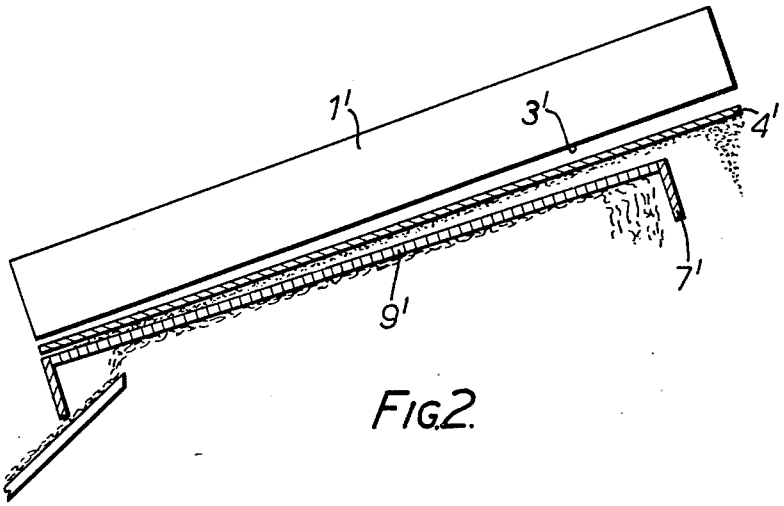

In order that the invention may be more readily understood it will now be described by way of example only, with reference to the accompanying drawings, in which:

FIG. 1 is a side elevation of the sieving device in acordance with one embodiment of the invention, and FIG. 2 is a side elevation of a sieving device in accordance with a second embodiment of the invention.

An electric linear thrust device is represented in FIG. 1 by reference numeral 1. The device is of elongate form and its windings are embedded in a resinous material to provide a substantially flat horizontal surface 3. This surface is arranged uppermost and substantially horizontal. A plate 4 is positioned above the surface 3 with an air gap 5 between the plate and the surface. The plate is inclined with respect to the surface so that the air gap increases along the length of the plate from left to right of the figure. A sieve 7 comprising a circular mesh 9 supported around its edge by an upstanding side wall 11 is positioned above the plate 4 and the plane of the mesh 9 is inclined to the plane of the plate 4 to provide an air gap 13 between them. The air gap increases in the direction from left to right of the figure.

The side wall 11 of the sieve is supported on a spider 15 which carries a post 17 which is rotatable in fixed bearings 19 thereby enabling the sieve to be rotated about the axis of the post.

A vibratory feeder has a channel member 21 projecting over the side wall of the sieve at the lowest part thereof.

The electrical connections to the linear thrust device are not shown. Basically however the device is a three phase device or a single phase device with a capacitor connected in one of the phases. When the device is energised it develops a linear thrust acting in the direction of the arrow 22 and if a plate of say aluminium were placed above the device it would be displaced in the direction 22. However, particles of magnetically susceptible materials are caused to move in the direction of the arrow 24, i.e. in the direction opposite to the direction of linear thrust.

In use, particles of a magnetically susceptible material are passed along the channel member 21 and fall into the sieve. When the linear thrust device is energised, the particles move along the mesh 9 in a path parallel to the length of the thrust member 1. The particles move with a motion having a component in the direction of the length of the device and a component at right angles to the mesh. In the main, only those particles which are larger than the mesh size arrive at the opposite side of the sieve. These particles are indicated by reference numeral 23. The smaller particles 25 pass through the mesh on to the upper surface of the plate 4 and are then transported to the right-hand end of the device where they collect and are periodically removed. The particles can be removed from the plate 4 by arranging for the last pole of the linear thrust device to be wound in opposite polarity to the remaining poles of the device thereby causing the particles to be ejected from the end of the plate. Alternatively the last pole may be pulsed perodically to cause the particles to fall off the plate into a receptacle (not shown).

After a batch of particles has been sieved and the larger particles 23 collected at the right-hand of the sieve, the sieve may be rotated through 180° and the particles caused to traverse across the mesh a second time. Any small particles remaining in with the larger particles are likely to fall through the mesh during the second pass across it.

The plate 4 may be a magnetically inert material such as polycarbonate. The plate 4 may lay on the surface of the thrust device so that the air gap 5 is zero. Furthermore the mesh 9 may be parallel with the plate 4 so that the air gap 13 is uniform along its length.

FIG. 2 shows an alternative construction in which the sieve 7' is inverted and positioned below a plate 4' which is in turn below the face 3' of a linear thrust device 1'. The plate 4' may be magnetically inert. The particles to be sieved are introduced on to the underside of the mesh 9' and those particles which are larger than the mesh openings pass along the mesh and either collect at the right-hand side of the mesh or fall off the mesh because at that end the magnetic effect of the linear thrust device is less due to the increased air gaps. The particles which pass through the mesh collect on the underside of the plate 4' and are transported to the right-hand side of the plate. Again the particles collect at the right-hand end and are caused to fall off the plate by the last pole of the device being either of opposite polarity or being pulsed periodically.

The linear thrust device may be a 415v 3ph 50 c/s unit type A84 manufactured and sold by Linear Motors Limited of Loughborough, England.

We claim:

1. A sieving device comprising a sieve having a mesh with openings of a given size therethrough, means for introducing particles of magnetically susceptible material some of which are of a size greater than said openings and some of which are of a size less than said openings on to the surface of a first side of the mesh; an electric linear thrust device of elongate form spaced from the mesh on the side there of remote from the particle introducing means, said thrust device, when energized, producing a magnetic field moving in the direction of its length and toward said particle introducing means;

said particles experiencing the magnetic field produced by the thrust device and being thrust along a path parallel to the thrust device but in a direction away from the particle introducing means, those particles of a size greater than said openings moving along a path on the surface of the mesh on to which they are introduced and those particles of a size less than said openings passing through the openings and moving along a path which is on the same side of the mesh as said thrust device.

2. A sieving device as claimed in claim 1, in which the mesh is positioned above the linear thrust device with an air gap therebetween.

3. A sieving device as claimed in claim 2, in which a plate is disposed between the mesh and the thrust device with an air gap between the mesh and the plate.

4. A sieving device as claimed in claim 3, in which the air gap increases from one end of the sieve to the other.

5. A sieving device as claimed in claim 3 or 4, in which the plate is of magnetically inert material.

6. A sieving device as claimed in claim 2 or 3, in which the sieve is rotatable about an axis normal to the plane of the mesh.

7. A sieving device as claimed in claim 1, in which the mesh of the sieve is positioned below the linear thrust device with an air gap therebetween.

8. A sieving device as claimed in claim 7, in which a plate is displaced between the mesh and the thrust device with an air gap between the mesh and the plate.

9. A sieving device as claimed in claim 8, in which the air gap increases from one end of the sieve to the other.

10. A sieving device as claimed in claim 8, in which an air gap is present between the plate and the thrust device, the air gap increasing from said one end of the sieve to the other.

* * * * *